US005874976A

United States Patent [19]

Katon et al.

[11] Patent Number: 5,874,976

[45] Date of Patent: Feb. 23, 1999

[54] INKJET CARTRIDGE FILL PORT ADAPTER

[75] Inventors: Robert Joseph Katon, Independence, Oreg.; Max S. Gunther, La Jolla, Calif.; Joseph E. Scheffelin, Poway, Calif.; David S. Hunt, San Diego, Calif.; Mark E. Young, Santa Rosa, Calif.; Elizabeth Zapata, Barcelona, Spain; Alfred Zepeda, San Marcos; Christopher J. Shultz, San Diego, both of Calif.

[73] Assignee: Hewlett-Packard Company, Palo Alto, Calif.

[21] Appl. No.: 726,587

[22] Filed: Oct. 7, 1996

[51] Int. Cl.[6] ..... B41J 2/175

[52] U.S. Cl. ..... 347/85

[58] Field of Search ..... 347/84, 85, 86, 347/87; 141/383, 386, 346; 227/188 R, 188 A, 189; 403/154, 155; 285/305, 321

[56] References Cited

U.S. PATENT DOCUMENTS

| | | | |
|---|---|---|---|
| 3,503,636 | 3/1970 | Bower | 285/305 |
| 4,429,320 | 1/1984 | Hattori et al. . | |
| 4,561,682 | 12/1985 | Tisserat | 285/305 |
| 4,700,202 | 10/1987 | Kuranishi et al. . | |
| 4,760,409 | 7/1988 | Kiyohara et al. . | |
| 4,928,126 | 5/1990 | Asai . | |
| 4,967,207 | 10/1990 | Ruder . | |
| 4,999,652 | 3/1991 | Chan . | |
| 5,280,300 | 1/1994 | Fong et al. . | |
| 5,293,913 | 3/1994 | Preszler | 347/86 |
| 5,369,429 | 11/1994 | Erickson . | |
| 5,400,573 | 3/1995 | Crystal et al. . | |
| 5,526,853 | 6/1996 | McPhee et al. | 141/383 |
| 5,673,073 | 9/1997 | Childers et al. | 347/86 |

FOREIGN PATENT DOCUMENTS

| | | | |
|---|---|---|---|
| 61-12347 | 1/1986 | Japan | 347/86 |
| 5-162330 | 6/1993 | Japan | 347/86 |

*Primary Examiner*—N. Le
*Assistant Examiner*—Judy Nguyen

[57] ABSTRACT

An inkjet cartridge is adapted to receive ink from an external ink supply reservoir. The inkjet cartridge includes an internal reservoir, printhead, housing, and fluid interface. The housing includes a first cylindrical port, a first connector and a second connector. The fluid interface provides fluid communication between the port and reservoir. An adapter secures a tube/needle valve from the supply reservoir to the port. The adapter includes a first member, a first protrusion and a second protrusion integrally formed as one structure. The first member defines an opening within which the needle valve is positioned. The first protrusion and second protrusion extend from the first member adjacent to the opening. The first protrusion engages the housing's first connector and the second protrusion engages the housing's second connector to attach the adapter to the housing. The valve mates to the port and a valve needle mates to the fluid interface.

19 Claims, 4 Drawing Sheets

INKJET CARTRIDGE FILL PORT ADAPTER

BACKGROUND OF THE INVENTION

This invention relates generally to inkjet cartridge construction, and more particularly to mechanisms for attaching an ink supply tube to an inkjet cartridge.

Modern inkjet printers employ a variety of ink cartridges for dispensing ink onto a media sheet. The cartridge typically includes an internal ink reservoir and a printhead. The printhead includes nozzles through which ink droplets are ejected. Ink is drawn from the reservoir into the nozzles. As inkjet printing technology has developed, one of the challenges has been to improve print quality and avoid clogging and failure of the inkjet printhead. A partial solution to these problems has been the development of inexpensive, disposable inkjet cartridges.

Disposable inkjet cartridges typically are designed to operate for a given useful life. The printhead is designed to function properly for a very high percentage of time during such useful life. One manner of ensuring that performance is maintained is to implement an internal reservoir having a specified capacity which is depleted before the printhead's useful life expires. When the reservoir is empty the cartridge is discarded.

The use of disposable cartridges has effectively assured that print quality is maintained within the failure rates dictated for a particular cartridge. When an existing inkjet cartridge runs out of ink, however, the printhead is still operating effectively in most cases. The printhead often has some useful life left. One result has been the development of an after-market in which used cartridges are refilled, resold and re-used. With the continued advancement of inkjet printhead technology, the useful life of the printhead has progressively outdistanced the conventional capacity of the disposable cartridge's internal reservoir. As a result, the refill market has evolved.

A benefit of the increasing useful life of the inkjet printhead and advancement of inkjet printhead technology has been the development of inkjet printing systems employing a print cartridge and an external high capacity supply reservoir. The supply reservoirs, not having the same limitations as the local cartridge are easily refilled or replaced. Typically, the supply reservoir is coupled to the print cartridge via an ink supply tube. The cartridge printhead thus is used for a life exceeding a one-time capacity of its internal reservoir.

SUMMARY OF THE INVENTION

According to the invention, a disposable inkjet cartridge is adapted to receive ink from an external ink supply reservoir. According to one aspect of the invention an adapter secures a needle valve to the inkjet cartridge housing at a refill port. One end of the valve mates to the refill port. A supply tube mates to the opposite end of the valve. The adapter holds the needle valve in place to assure a sealed, stable, reliable connection. In particular the adapter prevents the needle valve from inadvertently assuming a loose fitting connection.

The needle valve has a first end for receiving an ink supply tube and a second end for engaging the cartridge. In addition, the second end retracts to expose a hollow needle through which ink passes.

The inkjet cartridge includes an internal reservoir, a printhead, a housing, and a fluid interface. The housing includes a first cylindrical port, a first connector and a second connector. The port receives the needle valve. The first connector and second connector are located adjacent to and on opposing sides of the port. The fluid interface has a first end within the port and a second end within the reservoir. It establishes fluid communication between the port and the reservoir.

The adapter includes a first member, a first protrusion and a second protrusion, integrally formed as one structure. The first member has a first surface and a second surface, the second surface opposing the first surface. The first member defines an opening extending from the first surface to the second surface. The needle valve is positioned within the opening. The first protrusion extends from the first surface at a location adjacent to the opening. The second protrusion also extends from the first surface at a position adjacent to the opening, but opposite the first protrusion. The first protrusion engages the housing's first connector and the second protrusion engages the housing's second connector to attach the adapter to the housing. The second end of the needle valve mates to the port and the needle mates to the fluid interface while the adapter is attached to the housing.

In some embodiments the needle valve is held within the adapter opening with a retaining ring. The adapter first protrusion defines a first recess, the adapter second protrusion defines a second recess, and the needle valve defines a groove. The groove, first recess and second recess are aligned in a common plane. The retaining ring slides along the common plane within the first recess and second recess onto the needle valve at the needle valve groove locking the needle valve within the opening of the adapter.

To allow the adapter to hold the valve to the cartridge the adapter protrusions have opposing ridges which fit into corresponding first and second recesses of the housing first connector and second connector. In some embodiments the housing first connector has a U-shaped post with a first cross member defining the first recess. Similarly, the housing second connector has a U-shaped post with a second cross member defines the second recess. The first protrusion has a shape fitting to the first connector's U-shaped post and first recess. Similarly, the second protrusion has a shape fitting to the second connector's U-shaped post and second recess.

In preferred embodiments the cartridge port has an inner diameter which is less than an outer diameter of the retractable second end of the needle valve. The retractable cylinder is pushed back by the port as the first protrusion engages the first connector and the second protrusion engages the second connector. Such action unsheathes the valve needle allowing the needle to engage the fluid interface.

One advantage of the invention is that inexpensive disposable inkjet cartridge technology is effectively adapted for intermittent fill or continuous fill ink supply methods. Another advantage is that a reliable connection is achieved between an inkjet cartridge and an ink supply reservoir. The adapter maintains a connection between the cartridge and the needle valve while the cartridge is moved back and forth along a printer carriage during a print scanning operation. These and other aspects and advantages of the invention will be better understood by reference to the following detailed description taken in conjunction with the accompanying drawings.

DESCRIPTION OF SPECIFIC EMBODIMENTS

Inkjet Cartridge

Figure 1:
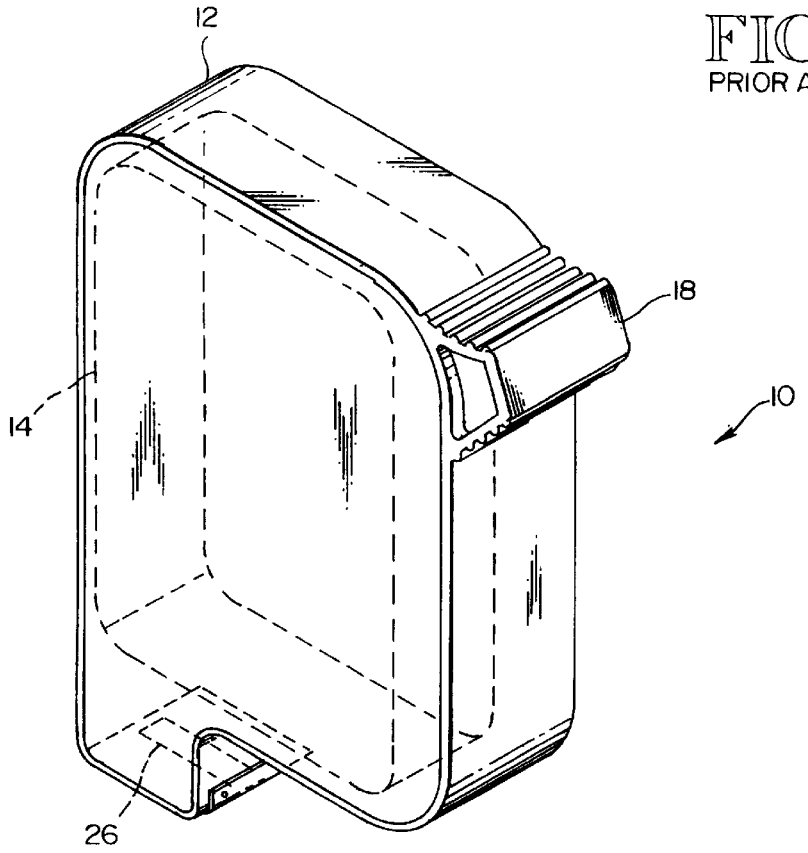
FIG. 1 PRIOR ART
FIG. 1 is a perspective view of a conventional disposable inkjet cartridge.

FIG. 1 shows a conventional disposable inkjet printing cartridge 10. The cartridge 10 includes a housing 12 which defines an internal reservoir 14 for storing ink. A printhead 26 with inkjet nozzles is mounted to the housing 12. The printhead receives ink from the reservoir 14 and ejects ink droplets during a printing operation. A protruding grip 18 extends from the housing 12 enabling convenient installation and removal from a print carriage (not shown) within an inkjet printer (not shown).

Figure 2:
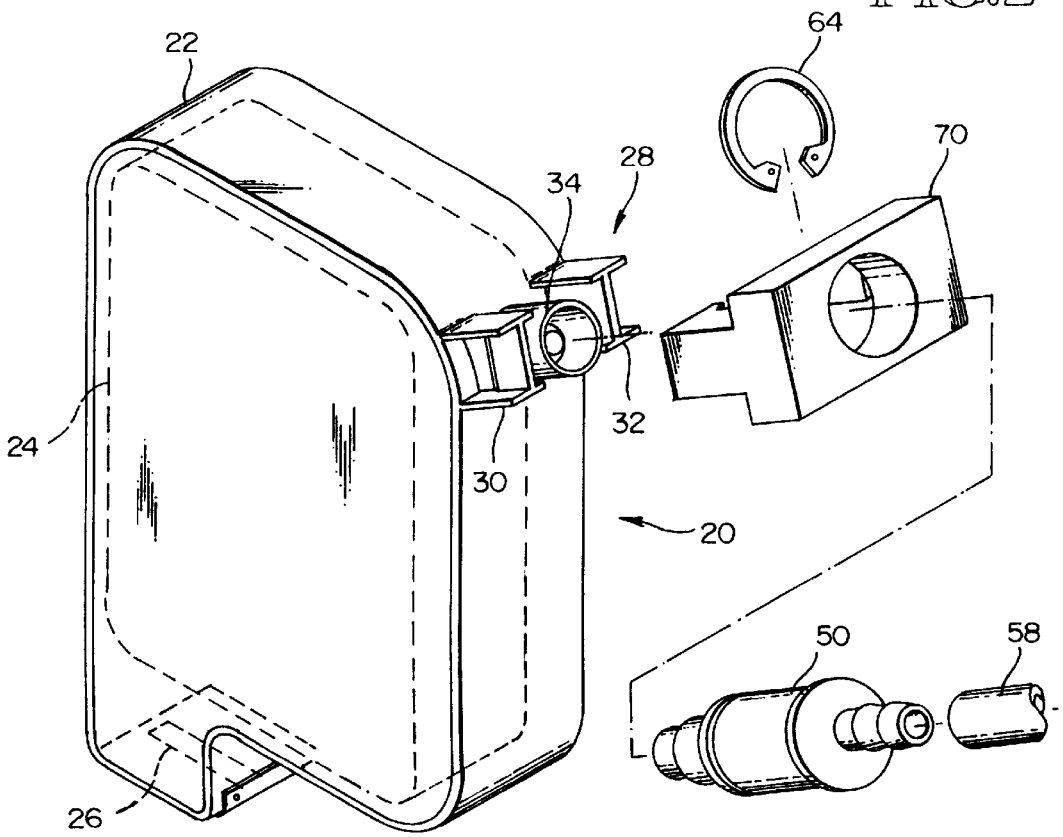
FIG. 2 is a partially exploded view of an inkjet cartridge with adapter, needle valve, and supply tube according to an embodiment of this invention.

FIG. 2 shows a disposable inkjet cartridge 20 which is adapted for continuous or intermittent refilling. The cartridge 20 includes a housing 22 which defines an internal reservoir 24 for storing ink. A printhead 26 with inkjet nozzles is mounted to the housing 22. The printhead 26 receives ink from the reservoir 24 and ejects ink droplets while the cartridge 20 scans back and forth along a print carriage during a printing operation. A protruding grip 28 extends from the housing 22 enabling convenient installation and removal from a print carriage (not shown) within an inkjet printer (not shown). The grip 28 is formed on an external surface of the housing 22.

Figure 3:
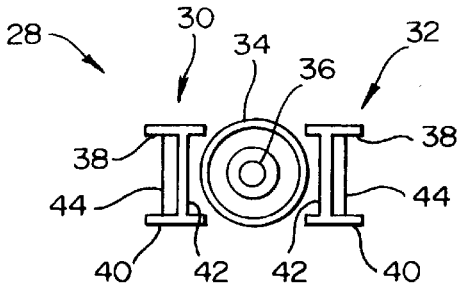
FIG. 3 is a planar view of the connectors and port of the inkjet cartridge of FIG. 2.
Figure 4:
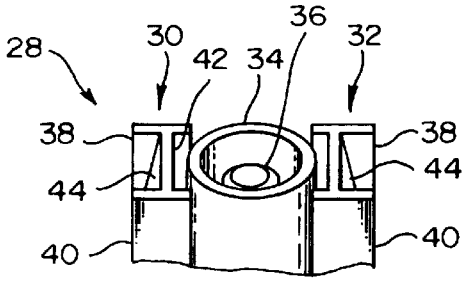
FIG. 4 is a perspective view of the connectors and port of FIG. 3.
Figure 5:
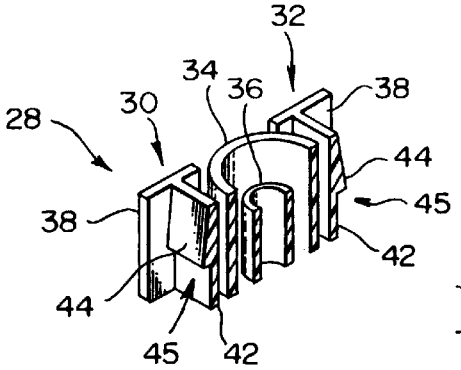
FIG. 5 is a cut-away view of the connectors and port of FIG. 4.
Figure 6:
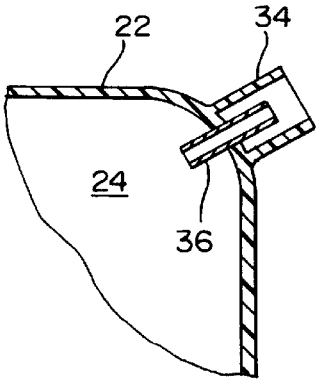
FIG. 6 is a cut-away view of a portion of the inkjet cartridge and port of FIG. 2.

FIGS. 3–5 show additional detail of the grip 28. The grip 28 differs from the conventional grip 18 of FIG. 1. The grip 28 includes two H-shaped connectors 30, 32 on opposing sides of a cylindrical port 34. Each connector 30, 32 is formed by two side walls 38,40 and a cross-beam 42. The connectors 30, 32 are aligned on opposing sides of the port 34 oriented with the cross-beams 42 facing each other, and the side walls 38 aligned and the side walls 40 aligned. The cross-beams 42 each define a ridge 44 and an incline 45, as shown most clearly in FIG. 5. In one embodiment the ridges 44 extend outward away from the port 34. The side walls 38, 40 and the cross-beams 42 extend to a common height defining connectors 30, 32 to be of a common height.

In a preferred embodiment the port 34 has an outer diameter equal to or less than the outer dimensional length from connector side wall 40 to connector side 42. The port 34 extends to a height equal to the height of the connectors 30, 32. Coaxially aligned within the port is a fluid interface tube 36. The interface tube 36 provides fluid communication between the port 34 and the internal reservoir 24. In one embodiment the interface tube is fixed. In an alternative embodiment (not shown) the interface tube moves between an open position and a closed position.

Needle valve

Figure 7:
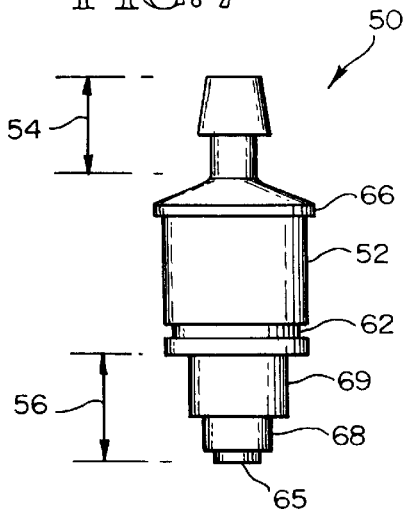
FIG. 7 is a planar view of the needle valve of FIG. 2.
Figure 8:
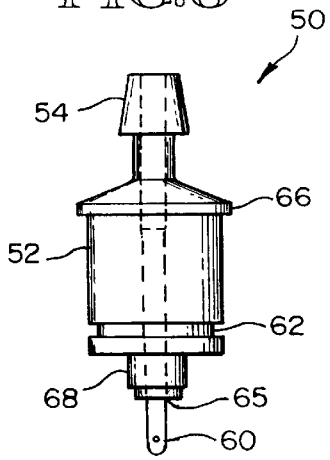
FIG. 8 is a planar view of the needle valve of FIG. 2 showing a needle.
Figure 9:
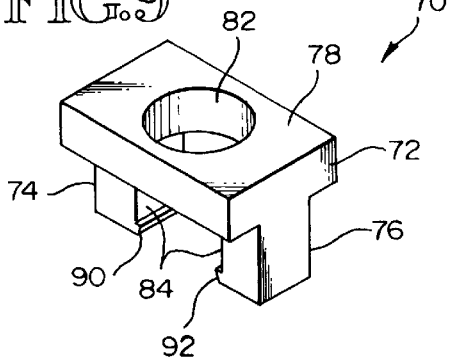
FIG. 9 is a perspective view of the adapter of FIG. 2.
Figure 10:
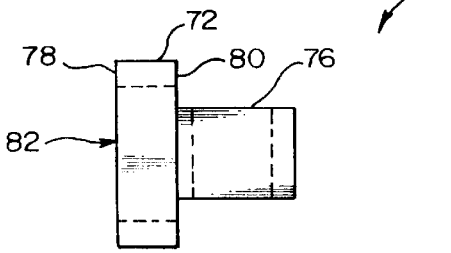
FIG. 10 is a planar view of the adapter of FIG. 9.
Figure 11:
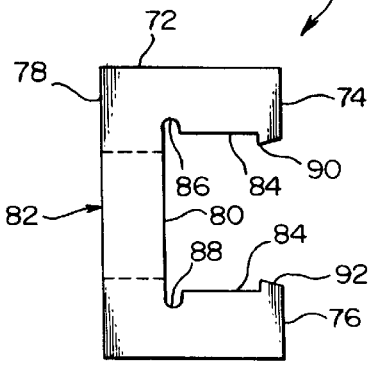
FIG. 11 is another planar view of the adapter of FIG. 9.
Figure 12:
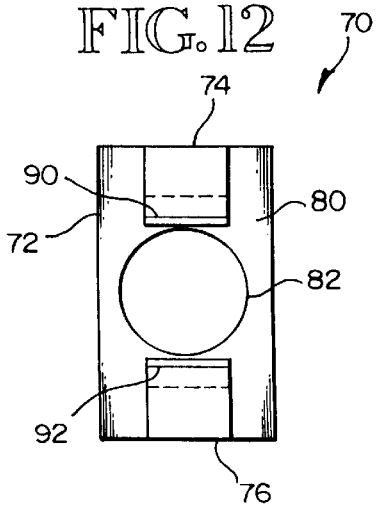
FIG. 12 is another planar view of the adapter of FIG. 9.
Figure 13:
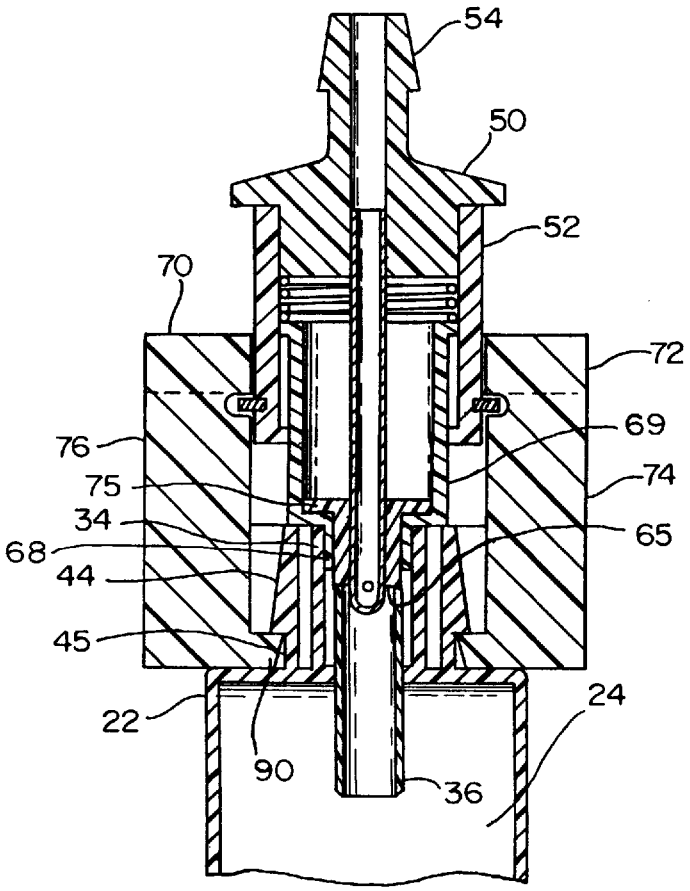
FIG. 13 is a cut-away view showing the adapter and needle valve attached to a portion of the inkjet cartridge housing of FIG. 2.
Figure 14:
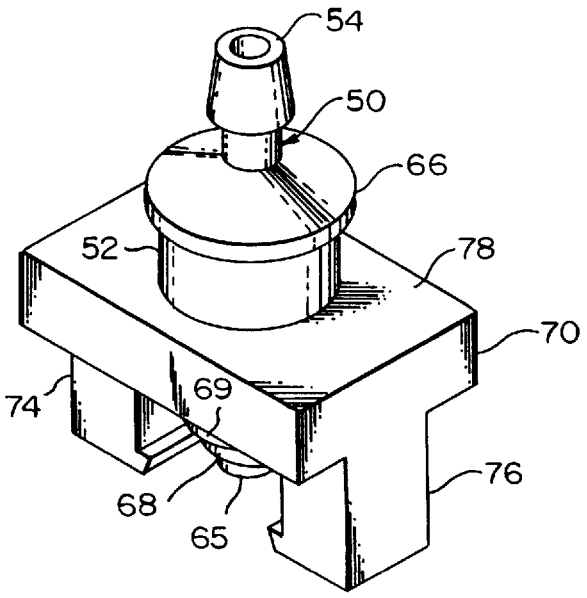
FIG. 14 is a perspective view of an adapter with an integral needle valve.

FIGS. 2 and 7–8 show a needle valve 50 which is to be connected to the inkjet cartridge housing 20 at the port 34. The needle valve 50 has a central cylindrical housing 52, a first end 54 and a second end 56. The first end 54 is tapered to receive a flexible tube 58 (see FIG. 2) from an external ink supply reservoir (not shown). The second end 56 is retractable under force into the central housing 52. The second end 56 however, is biased to an extended position. When the second end 56 is retracted, an internal needle 60 is exposed. The needle 60 is hollow and extends toward the first end 54 to receive ink from the supply tube 58. In some embodiments the cylindrical wall of the needle 60 is hidden when the second end 56 is fully extended to its relaxed position. In other embodiments a portion of the needle is exposed even when the second end 56 is fully extended to its relaxed position.

In one embodiment the second end 56 is cylindrical and has, along its widest portion 69, a first diameter. A distal portion 68 of the second end 56, however, has a second diameter smaller than the first diameter. Preferably, the second diameter also is less than the inner diameter of the cartridge port 34. An elastomeric seal 65 is protruding from a distal edge of the distal portion 68.

A groove 62 is formed on the external surface of the central cylindrical housing 52 toward the second end 56. The groove 62 extends circumferentially around the cylindrical housing 52. Referring to FIG. 2, a retaining ring 64 fits to the groove 62. The central housing 52 has a ridge 66 toward the first end 54. In some embodiment the ridge 66 abuts the housing 52 toward the first end 54. The ridge 66 defines a wider diameter than the portion of the housing 52 extending toward the second end 56.

Adapter

FIGS. 2 and 9–12 show an adapter 70 according to an embodiment of this invention. The adapter 70 is for removably attaching the needle valve 50 to the inkjet cartridge 20. The adapter 70 holds the needle valve 50 in place to assure a sealed, stable, reliable connection. In particular the adapter 70 prevents the needle valve 50 from inadvertently assuming a loose fitting connection to the cartridge 20.

The adapter 70 includes a support member 72 with two leg protrusions or extensions 74, 76. In a preferred embodiment the support member 72 and two extensions 74, 76 are formed as a single integral structure. The support member 72 has a first surface 78 and a second opposing surface 80. An opening 82 extends through the support member 72 from the first surface 78 to the second surface 80. The opening 82 is cylindrical having a diameter equal to the outer diameter of the needle valve's 50 cylindrical housing 52. The opening 82 outer diameter has sufficient tolerance to allow the needle valve housing 52 to slide into the opening 82.

Each leg extension 74, 76 protrudes from the second surface 80. Each leg extension 74, 76 also has an inner surface 84 facing each other on opposing sides of the opening 82. Along the leg extension 74 inner surface 84 is formed a recess 86 (see FIG. 11) toward the second surface 80. Similarly, along the leg extension 76 inner surface 84 is formed a recess 88 toward the second surface 80. In one embodiment the recesses 86, 88 are formed adjacent to the second surface 80. The recesses 86, 88 receive the needle valve retaining ring 64 during installation and attachment of the needle valve 50 to the cartridge 20.

A ridge 90 (see FIGS. 9, 11) is formed along the inner surface 84 of the leg extension 74. Similarly, a ridge 92 is formed along the inner surface 86 of the leg extension 76. The ridges 90, 92 serve to clamp the adapter 70 to the connectors 30, 32 of the cartridge 20.

Securing the Needle valve to the Inkjet Cartridge Housing

The adapter 70 secures the needle valve 50 to the inkjet cartridge housing 22. Before attaching the adapter 70 to the cartridge 20, the needle valve 50 is coupled to the adapter 70. To do so, the needle valve second end 56 is slid from the adapter first surface 78 through the opening 82. The needle valve ridge 66 has a diameter wider than the opening 82 preventing the needle valve 50 from sliding all the way through the opening 82. The needle valve second end 56 extends away from the second surface with the adapter leg extensions 74, 76.

To prevent the needle valve from being withdrawn from the adapter 70, the needle valve 50 is moved within the opening to align the needle valve groove 62 with the leg extensions 74, 76 recesses 86, 88. Preferably, the groove 62 and recesses 86, 88 align into a common plane. The retaining ring 64 then is slid along the common plane through the recesses and around the needle valve at the groove 62. The retaining ring 64 mates to the groove 62 about the circumference of the needle valve housing 52. The recesses 86, 88 prevent the retaining ring 62 from moving out of the common plane. thus, the recesses lock the needle valve in place preventing the needle valve 50 from moving axially within the opening 82 beyond the play of the recesses 86, 88.

With the needle valve 50 axially locked in place the second end 56 extends a length beyond the length of the leg extensions 74, 76. In some embodiments the second end 56 does not extend beyond the leg extensions 74,76, but the needle 60 does.

The adapter 70 with needle valve 50 is now attached to the cartridge housing 22 by sliding the adapter leg extensions 74, 76 onto the cartridge connectors 30, 32. The cartridge connectors 30, 32 each define a U-shaped portion along which a respective adapter leg extension 74, 76 is pushed. As the adapter 70 is pushed toward the cartridge housing 22 the leg extension ridges 90, 92 slide along the respective connector 30, 32 cross-beams 42 over the cross-beam ridges 44 onto respective inclines 45. In effect the leg extension ridges 90, 92 clamp the adapter 70 to the cartridge connectors 30, 32 at the connector inclines 45. The ridges 90, 92 mate to the ridges 44 and inclines 45 to secure the adapter 70 to the cartridge 20.

During the pushing or sliding action between the adapter 70 and the cartridge 20, the distal portion 68 the needle valve second end 56 mates to the cartridge port 34. A portion 69 of the second end 56, however, has an outer diameter wider than the inner diameter of the port 34. As a result such portion 69 does not mater to the port 34. The continued pushing action on the adapter 70 therefore forces the second end 56 to retract into the needle valve housing 52. The needle 60, however, does not retract and travels into the port 34. As the pushing action continues, the needle 60 mates to the fluid interface tube 36 within the port. The seal 65 is located at the distal edge of the second end 56. Such seal butts up against the fluid interface tube 36 The seal prevents ink exiting the needle into the tube 36 from leaking into or beyond the port 34. In an alternative embodiment (not shown) the seal pushes the tube inward moving the tube from a closed position to an open position.

The supply tube 58 is attached to the needle valve first end 54 at any time before, during or after the installation and attachment of the needle valve 50 and adapter 70 to the cartridge 20.

In an embodiment as shown in FIG. 15, the needle valve 50 is formed integral to the adapter 70. The adapter 70 with needle valve 50 are attached to the inkjet cartridge housing 22 in the same manner as described above for the embodiments in which the adapter and needle valve are separate components.

Meritorious and Advantageous Effects

One advantage of the invention is that inexpensive disposable inkjet cartridge technology is effectively adapted for intermittent fill or continuous fill ink supply methods. Another advantage is that a reliable connection is achieved between an inkjet cartridge and an ink supply reservoir.

Although a preferred embodiment of the invention has been illustrated and described, various alternatives, modifications and equivalents may be used. For example, although the leg extension ridges 90, 92 face inward toward the opening 82 and the cartridge connector ridges 44 correspondingly face outward away from the port 34, the orientations may differ. In an alternative embodiment the leg extension ridges 90, 92 are on opposite surfaces of the extensions 74, 76 protruding outward away from the opening 82. Correspondingly, the connector ridges 44 face inward toward the port 34. In such embodiment the U-shaped portion of the connectors 30, 32 extend in a reversed direction.

In another alternative embodiment the cartridge connectors 30, 32 are cylindrical, instead of H-shaped and the adapter legs correspondingly are cylindrical instead of rectilinear. In such embodiment the leg extensions mate to the connectors and snap into place by action between ridges of the connectors (or leg extensions) and recesses along the leg extensions (or connectors).

In another embodiment the needle valve seals to the adapter and the adapter includes a fluid interface between the needle valve and inkjet cartridge.

In another embodiment of the needle valve, the humidor providing a seal for the internal needle is formed of soft silicon, foamed silica, foamed EPDM or other pliable material. When the needle valve attaches to the cartridge the needle covering is pushed back into the pliable material. In another embodiment a spring biases the needle cover closed. When the needle valve is attached to the cartridge the attaching action causes the needle cover to retract compressing the spring and exposing the needle. Therefore, the foregoing description should not be taken as limiting the scope of the inventions which are defined by the appended claims.

What is claimed is:

1. An inkjet cartridge system for receiving ink through an ink supply tube, the system comprising:

a housing having an external surface upon which are formed a cylindrical port, a first connector and a second connector, wherein the first connector and second connector are located adjacent to the port;

an internal reservoir for storing ink, the housing encasing the reservoir;

a printhead for receiving ink from the internal reservoir and for ejecting ink droplets, the printhead mounted to the housing;

a fluid interface having a first end within the port and a second end within the reservoir, the fluid interface for establishing fluid communication between the port and the reservoir;

a needle valve having a first end for receiving the supply tube and a second end for engaging the housing at the port, the needle valve having an internal channel through which ink passes, the channel extending from the first end to the second end, the needle valve including an internal hollow needle located within the channel; and an adapter separable from the housing and needle valve for securing the needle valve to the housing, the adapter comprising: an adapter member, a first protrusion and a second protrusion; wherein the adapter member, first protrusion and second protrusion are integrally formed as a single structure; the adapter member having a first surface and a second surface, the second surface opposing the first surface, the adapter member having an opening extending from the second surface to the first surface and within which the needle valve is positioned, the first protrusion extending from the second surface at a location adjacent to the opening, the second protrusion extending from the second surface at a position adjacent to the opening; and wherein the first protrusion engages the first connector and the second protrusion engages the second connector to attach the adapter to the housing, and wherein the second end of the needle valve mates to the port and the needle mates to the fluid interface while the adapter is attached to the housing.

2. The inkjet cartridge system of claim 1, in which the needle valve includes a retractable cylinder at the second end of the needle valve, the retractable cylinder concentrically surrounding a portion of the needle, and in which the port has an inner diameter less than an outer diameter of the retractable cylinder of the needle valve, and wherein the retractable cylinder is pushed back by the port unsheathing the needle, when the adapter attaches to the housing.

3. The inkjet cartridge system of claim 1, in which the first protrusion includes a first ridge, in which the second protrusion includes a second ridge; and in which the housing first connector has a first area for receiving the first ridge and the housing second connector has a second area for receiving the second ridge.

4. The inkjet cartridge system of claim 1, in which the housing first connector comprises a U-shaped post having a first cross member which has a first area and in which the housing second connector comprises a U-shaped post having a second cross member which has a second area; and wherein the first protrusion is of a shape fitting to the U-shaped post of the first connector, and wherein the second protrusion is of a shape fitting to the U-shaped post of the second connector, the first protrusion including a first ridge for clamping said first area, the second protrusion including a second ridge for clamping said second area.

5. An inkjet cartridge system for receiving ink through an ink supply tube and a needle valve, the needle valve having a first end for receiving the supply tube and a second end for engaging a housing, the needle valve having an internal channel through which ink passes, the channel extending from the first end to the second end, the needle valve including an internal hollow needle located within the channel, the cartridge system comprising:

an internal reservoir for storing ink;

a printhead for receiving ink from the internal reservoir and for ejecting ink droplets;

the housing encasing the reservoir and to which the printhead is mounted, the housing having an external surface upon which are formed a cylindrical port, a first connector and a second connector, wherein the first connector and second connector are located adjacent to the port;

a fluid interface having a first end within the port and a second end within the reservoir, the fluid interface for establishing fluid communication between the port and the reservoir;

an adapter separable from the housing and needle valve for securing the needle valve to the housing, the adapter comprising: an adapter member, a first protrusion and a second protrusion; wherein the adapter member, first protrusion and second protrusion are integrally formed as a single structure; the adapter member having a first surface and a second surface, the second surface opposing the first surface, the adapter member having an opening extending from the second surface to the first surface and within which the needle valve is positioned, the first protrusion extending from the second surface at a location adjacent to the opening, the second protrusion extending from the second surface at a position adjacent to the opening, wherein the first protrusion engages the first connector and the second protrusion engages the second connector to attach the adapter to the housing, and wherein the second end of the needle valve mates to the port and the needle mates to the fluid interface while the adapter is attached to the housing; and a retaining ring, and in which the first protrusion includes a first recess and the second protrusion includes a second recess, and in which the needle valve includes a groove about a circumference of the needle valve; and wherein the first recess, second recess, and groove align into a common plane to receive the retaining ring, the retaining ring locking the needle valve within the opening of the adapter.

6. An adapter for removably securing a needle valve to an inkjet cartridge, the needle valve having a first end for receiving an ink supply tube and a second end for engaging the cartridge, the needle valve having an internal channel, the channel extending from the first end to the second end, the needle valve including an internal hollow needle located along the channel, the inkjet cartridge having an internal reservoir, a printhead, a housing, and a fluid interface, the printhead for receiving ink from the reservoir and for ejecting ink droplets, the housing encasing the reservoir and having an external surface upon which are formed a cylindrical port, a first connector and a second connector, the first connector and second connector located adjacent to and on opposing sides of the port, the adapter comprising:

an adapter member having a first surface and a second surface, the second surface opposing the first surface, the adapter member having an opening extending from the first surface to the second surface for receiving the needle valve;

a first protrusion extending from the second surface at a location adjacent to the opening; and a second protrusion extending from the second surface at a position adjacent to the opening, and wherein the adapter member, first protrusion and second protrusion are integrally formed as a single structure; and wherein the first protrusion engages the first connector and the second protrusion engages the second connector when attaching the adapter to the housing, and wherein the second end of the needle valve mates to the port and the needle mates to the fluid interface while the needle valve is within the opening and the adapter is attached to the housing, the fluid interface having a first end within the port and a second end within the reservoir, the fluid interface for establishing fluid communication between the port and the reservoir.

7. The adapter of claim 6, further comprising the needle valve integrally formed within the opening.

8. The adapter of claim 6, in which the first protrusion includes a first ridge, in which the second protrusion includes a second ridge; and in which the housing first connector has a first area for receiving the first ridge and the housing second connector has a second area for receiving the second ridge.

9. The adapter of claim 6, in which the housing first connector comprises a U-shaped post having a first cross member which has a first area and in which the housing second connector comprises a U-shaped post having a second cross member which has a second area; and wherein the first protrusion is of a shape fitting to the U-shaped post of the first connector, and wherein the second protrusion is of a shape fitting to the U-shaped post of the second connector, the first protrusion including a first ridge for clamping said first area, the second protrusion including a second ridge for clamping said second area.

10. The adapter of claim 6, in which the needle valve includes a retractable cylinder at the second end of the needle valve, the retractable cylinder concentrically surrounding a portion of the needle, and in which the cartridge port has an inner diameter less than an outer diameter of the retractable cylinder of the needle valve, and wherein the retractable cylinder is pushed back by the port unsheathing the needle to engage the fluid interface as the first protrusion engages the first connector and the second protrusion engages the second connector.

11. An adapter in combination with a retaining ring, the adapter for removably securing a needle valve to an inkjet cartridge, the needle valve having a first end for receiving an ink supply tube and a second end for engaging the cartridge, the needle valve having an internal channel, the channel extending from the first end to the second end, the needle valve including an internal hollow needle located along the channel, the inkjet cartridge having an internal reservoir, a printhead, a housing, and a fluid interface, the printhead for receiving ink from the reservoir and for ejecting ink droplets, the housing encasing the reservoir and having an external surface upon which are formed a cylindrical port, a first connector and a second connector, the first connector and second connector located adjacent to and on opposing sides of the port, the adapter comprising:

an adapter member having a first surface and a second surface, the second surface opposing the first surface, the adapter member defining an opening extending from the first surface to the second surface for receiving the needle valve;

a first protrusion extending from the first surface at a location adjacent to the opening; and a second protrusion extending from the first surface at a position adjacent to the opening, and wherein the adapter member, first protrusion and second protrusion are integrally formed as a single structure;

wherein the first protrusion engages the first connector and the second protrusion engages the second connector when attaching the adapter to the housing, and wherein the second end of the needle valve mates to the port and the needle mates to the fluid interface while the needle valve is within the opening and the adapter is attached to the housing, the fluid interface having a first end within the port and a second end within the reservoir, the fluid interface for establishing fluid communication between the port and the reservoir;

in which the first protrusion includes a first recess and the second protrusion includes a second recess, and in which the needle valve includes a groove about a circumference of the needle valve; and wherein the first recess, second recess, and groove align into a common plane to receive the retaining ring, the retaining ring locking the needle valve within the opening of the adapter.

12. A method for securing a needle valve to an inkjet cartridge, the needle valve having a first end for receiving an ink supply tube and a second end for engaging the cartridge, the needle valve including an internal hollow needle through which ink passes, the inkjet cartridge having an internal reservoir, a printhead, a housing, and a fluid interface, the printhead for receiving ink from the reservoir and for ejecting ink droplets, the housing encasing the reservoir and having an external surface upon which are formed a cylindrical port, a first connector and a second connector, the first connector and second connector located adjacent to the port, the method comprising the steps of:

inserting the needle valve second end through an opening of an adapter, the adapter comprising a adapter member, a first protrusion and a second protrusion, the adapter member having a first surface and a second surface, the second surface opposing the first surface, the opening extending from the first surface to the second surface, the first protrusion extending from the second surface at a location adjacent to the opening, the second protrusion extending from the second surface at a position adjacent to the opening, and the adapter member, first protrusion and second protrusion being integrally formed as a single structure, the first protrusion including a first recess and the second protrusion including a second recess, the needle valve including a groove about a circumference of the needle valve;

aligning the first recess, second recess, and groove into a common plane;

sliding a retaining ring along the common plane within the first recess and second recess onto the needle valve at the needle valve groove, the retaining ring locating the needle valve within the opening of the adapter; and attaching the adapter to the cartridge housing, wherein the first protrusion engages the first connector and the second protrusion engages the second connector, and wherein the second end of the needle valve mates to the port and the needle mates to the fluid interface, the fluid interface having a first end within the port and a second end within the reservoir, the fluid interface establishing fluid communication between the port and the reservoir.

13. The method of claim 12, in which the first protrusion has a first ridge, in which the second protrusion has a second ridge; in which the housing first connector has a first area; in which the housing second connector has a second area; and wherein the step of attaching comprises engaging the first ridge of the first protrusion at the first area of the first connector, and engaging the second ridge of the second protrusion at the second area of the second connector.

14. The method of claim 12, in which the housing first connector comprises a U-shaped post having a first cross member which has a first area and in which the housing second connector comprises a U-shaped post having a second cross member which has a second area, and wherein the first protrusion is of a shape fitting to the U-shaped post of the first connector, and wherein the second protrusion is of a shape fitting to the U-shaped post of the second connector, the first protrusion including a first ridge for clamping said first area, the second protrusion including a second ridge for clamping said second area; and wherein the step of attaching comprises engaging the first ridge of the first protrusion at the first cross member first area of the first connector, and engaging the second ridge of the second protrusion at the second cross member second area of the second connector.

15. The method of claim 12, in which the needle valve includes a retractable cylinder at the second end of the needle valve, the retractable cylinder concentrically surrounding a portion of the needle, and in which the port has an inner diameter less than an outer diameter of the retractable cylinder of the needle valve, and further comprising the steps of pushing back the retractable cylinder with the port to unsheathe the needle, and engaging the fluid interface with the needle, said steps of pushing and engaging performed during said step of attaching.

16. An ink supply system for an inkjet pen cartridge, the system comprising:

an inkjet cartridge housing having an external surface upon which are formed a cylindrical port, a first connector and a second connector, wherein the first connector and second connector are located adjacent to the port;

an internal reservoir within the housing for storing ink;

a printhead for receiving ink from the internal reservoir and for ejecting ink droplets, wherein the printhead is mounted to the housing;

a fluid interface having a first end within the port and a second end within the reservoir, the fluid interface for establishing fluid communication between the port and the reservoir;

a needle valve having a first end for receiving an ink supply tube and a second end for engaging the port, the needle valve having an internal channel extending from the first end to the second end, the needle valve including an internal hollow needle located within the channel; and an adapter separable from the housing and needle valve for securing the needle valve to the housing, the adapter having an opening into which the needle valve is received, the adapter including a first protrusion and a second protrusion respectively located adjacent to the opening, and wherein the first protrusion engages the housing first connector and the second protrusion engages the housing second connector to attach the adapter to the housing, and wherein the second end of the needle valve mates to the port and the needle mates to the fluid interface while the adapter is attached to the housing and the needle valve is received into the adapter opening.

17. The system of claim 16, further comprising a retaining ring, and in which the adapter first protrusion includes a first recess and the adapter second protrusion includes a second recess, and in which the needle valve includes a groove about a circumference of the needle valve; and wherein the first recess, second recess, and groove align into a common plane to receive the retaining ring, the retaining ring locking the needle valve within the opening of the adapter.

18. The system of claim 16, in which the needle valve includes a retractable cylinder at the second end of the needle valve, the retractable cylinder concentrically surrounding a portion of the needle, and in which the housing port has an inner diameter less than an outer diameter of the retractable cylinder of the needle valve, and wherein the retractable cylinder is pushed back by the port during attachment of the adapter and needle valve to the housing, wherein the needle is unsheathed by the pushing back of the retractable cylinder, the needle engaging the fluid interface.

19. A method for securing a needle valve to an inkjet cartridge, the needle valve having a first end for receiving an ink supply tube and a second end for engaging the cartridge, the needle valve including an internal hollow needle through which ink passes, the inkjet cartridge having an internal reservoir, a printhead, a housing, and a fluid interface, the printhead for receiving ink from the reservoir and for ejecting ink droplets, the housing encasing the reservoir and having an external surface upon which are formed a cylindrical port and a connector, the connector located adjacent to the port, the method comprising the steps of:

inserting the needle valve second end through an opening of an adapter, the adapter comprising a first protrusion and a second protrusion respectively located adjacent to the opening, the first protrusion including a first recess and the second protrusion including a second recess, the needle valve including a groove about a circumference of the needle valve;

aligning the first recess, second recess, and groove into a common plane;

sliding a retaining ring along the common plane within the first recess and second recess onto the needle valve at the needle valve groove, the retaining ring locking the needle valve within the opening of the adapter; and attaching the adapter to the housing, wherein the first protrusion and second protrusion engage the connector, and wherein the second end of the needle valve mates to the port and the needle mates to the fluid interface, the fluid interface having a first end within the port and a second end within the reservoir, the fluid interface establishing fluid communication between the port and the reservoir.

* * * * *